US009616655B2

(12) United States Patent
Rancourt et al.

(10) Patent No.: US 9,616,655 B2
(45) Date of Patent: Apr. 11, 2017

(54) METHOD FOR REDUCING WEB PRINTING PRESS START-UP WASTE, AND RELATED PRINTING PRESS AND PRINTED PRODUCT

(71) Applicant: GOSS INTERNATIONAL AMERICAS, INC., Durham, NH (US)

(72) Inventors: Michael Raymond Rancourt, Merrimack, NH (US); Howard W. Hoff, Lee, NH (US); Laura Schuler Cossette, Brentwood, NH (US)

(73) Assignee: Goss International Americas, Inc., Durham, NH (US)

( * ) Notice: Subject to any disclaimer, the term of this patent is extended or adjusted under 35 U.S.C. 154(b) by 89 days.

(21) Appl. No.: 14/565,031

(22) Filed: Dec. 9, 2014

(65) Prior Publication Data

US 2015/0174889 A1 Jun. 25, 2015

Related U.S. Application Data

(60) Provisional application No. 61/918,364, filed on Dec. 19, 2013.

(51) Int. Cl.

| | |
|---|---|
| ***B41L 35/14*** | (2006.01) |
| ***B41F 13/02*** | (2006.01) |
| ***B41F 33/00*** | (2006.01) |
| ***B41F 13/04*** | (2006.01) |

(52) U.S. Cl.

CPC ..... *B41F 13/025* (2013.01); *B41F 13/02* (2013.01); *B41F 13/04* (2013.01); *B41F 33/0036* (2013.01); *B41P 2233/11* (2013.01); *B41P 2233/13* (2013.01); *Y10T 428/24851* (2015.01)

(58) Field of Classification Search

CPC ..... B41F 13/02
USPC ..... 101/488
See application file for complete search history.

(56) References Cited

U.S. PATENT DOCUMENTS

| | | | | |
|---|---|---|---|---|
| 4,852,785 | A * | 8/1989 | Bettendorf | B41J 15/04 101/181 |
| 5,949,550 | A * | 9/1999 | Arndt | A61B 18/12 356/430 |
| 6,108,513 | A * | 8/2000 | Landa | G03G 15/232 399/309 |
| 8,075,211 | B2 * | 12/2011 | Yamamoto | G03G 15/5062 270/21.1 |
| 8,256,345 | B2 * | 9/2012 | Denninger | B41F 7/12 101/424.1 |

(Continued)

FOREIGN PATENT DOCUMENTS

| | | |
|---|---|---|
| DE | 3023678 B1 | 7/1981 |
| EP | 0891684 A1 | 1/1999 |

(Continued)

*Primary Examiner* — Anthony Nguyen
(74) *Attorney, Agent, or Firm* — Davidson, Davidson & Kappel, LLC

(57) ABSTRACT

A method for operating a web printing press is provided. The method includes unwinding a substrate from a roll to define a web; during makeready, printing the web using at least one print unit, the makeready ending when the web is being printed to a desired standard; stopping the web after the makeready; rewinding the web so that the substrate printed during the make ready pass back through the print unit; and unwinding again the rewound substrate to pass through the print unit. A press and printed product are also provided.

7 Claims, 3 Drawing Sheets

(56) References Cited

U.S. PATENT DOCUMENTS

| | | | | |
|---|---|---|---|---|
| 8,316,764 | B1 * | 11/2012 | Wu | B29D 11/0074 101/34 |
| 2004/0182262 | A1 * | 9/2004 | Seymour | B41F 33/0045 101/211 |
| 2006/0005722 | A1 * | 1/2006 | Nobukawa | B41F 13/12 101/181 |
| 2007/0022892 | A1 * | 2/2007 | Currans | B41F 33/00 101/483 |
| 2009/0188405 | A1 * | 7/2009 | Stiel | B41F 17/00 101/484 |
| 2011/0297026 | A1 * | 12/2011 | Zeinhofer | B41F 13/025 101/481 |
| 2011/0310417 | A1 * | 12/2011 | Takemoto | B41F 33/0036 358/1.13 |
| 2012/0234192 | A1 * | 9/2012 | Schnabel | B41F 21/00 101/481 |

FOREIGN PATENT DOCUMENTS

| | | | |
|---|---|---|---|
| EP | 2749414 | A1 | 7/2014 |
| GB | 1557652 | A | 12/1979 |

* cited by examiner

METHOD FOR REDUCING WEB PRINTING PRESS START-UP WASTE, AND RELATED PRINTING PRESS AND PRINTED PRODUCT

Priority is hereby claimed to U.S. Provisional Application No. 61/918,364 filed on Dec. 19, 2013, the entire disclosure of which is hereby incorporated by reference herein.

BACKGROUND

During makeready on a web printing press considerable waste can be generated. The images on the web must be properly registered and the proper ink film densities established to create a properly appearing image on a substrate.

The substrate printed prior to proper registration and ink density establishment is considered waste and typically discarded.

Variable cut-off web printing presses for printing a variety of substrates, for example for use in packaging are known. For example the GOSS SUNDAY 3000V variable cut-off printing press can print on cardboard, paper, plastic and other substrates.

SUMMARY OF THE INVENTION

The present invention provides a method for reusing substrate created during makeready of a web printing press, for example substrate not properly registered or inked during makeready or substrate properly registered and inked but not coated.

The present invention provides a method for operating a web printing press comprising the steps of unwinding a substrate from a roll to define a web, during makeready, printing the web using at least one print unit, the makeready ending when the web is being printed to a desired standard, stopping the web after the makeready, rewinding the web so that the substrate printed during the make ready passes back through the print unit and unwinding again the rewound substrate to pass through the print unit.

The method permits reuse of the substrate processed during makeready. Especially for images that need not be of exacting quality, such as many packaging applications. In addition, for expensive substrates, the present invention can significantly reduce start-up waste and reduce costs.

The desired standard preferably is determined by measuring the optical densities of the printed images to within a desired target density. A color bar for example can be printed and measured by a sensor.

Before the rewinding step, any web guides can be set to guide a reversing web.

Also before the rewinding step, the at least one print unit preferably is thrown off impression to stop printing, and the printed substrate passes through any curing units, such as a dryer or UV curing unit, to set the ink. This step can insure that the web, once rewound, does not adhere and stick for future unwinding during the reprint step.

Preferably, during the unwind again step, the substrate is reprinted, over the previous makeready images. However, if a coater is part of the print configuration, the coater is not run during the makeready, and if the makeready images are acceptable according to the desired standard, the substrate during the unwind again step could simply then be coated without necessarily requiring a reprinting, and the print unit set on impression once the rewound web is unwound again and a white web is reached.

If the desired optical density on reaching white web (unprinted substrate) after the unwind again step is not acceptable, the stopping, rewinding and unwind again steps can be repeated.

Ink keys can be preset prior to makeready, and then adjusted as a function of the desired optical density on the substrate during makeready.

A job counter can track the substrate length or impression cylinder counts to track the substrate used during each makeready cycle.

The present invention also provides a web printing press comprising a roll stand for a substrate roll, the roll stand including a reversible motor, at least one web guide for guiding a web unwound from the substrate roll, at least one print unit for printing the web, at least one sensor for sensing an image printed on the substrate and a controller for rewinding the web as a function of an input from the sensor.

The sensor preferably includes an optical density sensor and a register sensor.

The press can include at least one web guide for guiding a web unwound from the substrate roll, the web guide being a reversing web guide.

The roll stand can include edge sensors and at least one web guide as well to insure proper rewinding.

The at least one print unit preferably includes a plurality of print units, for example four, for color printing of the web.

The print unit preferably is a variable cut-off print unit, and may have a plate and blanket cylinder on one side of the web, and an impression cylinder on the other. The print unit may be an offset lithographic print unit.

The press preferably further includes at least one curing unit, such as a dryer or a UV curing unit.

The press also further includes at least one counter for tracking substrate length or impression cylinder counts.

The present invention also provides a printed product comprising a substrate, a first makeready printed image below a certain standard, and a second image overtop the first makeready printed image.

BRIEF DESCRIPTION OF THE DRAWINGS

Further features and advantages of the present invention shall now be described in greater detail according to the accompanying figures in the following detailed description.

DETAILED DESCRIPTION OF A PREFERRED EMBODIMENT

Figure 1:
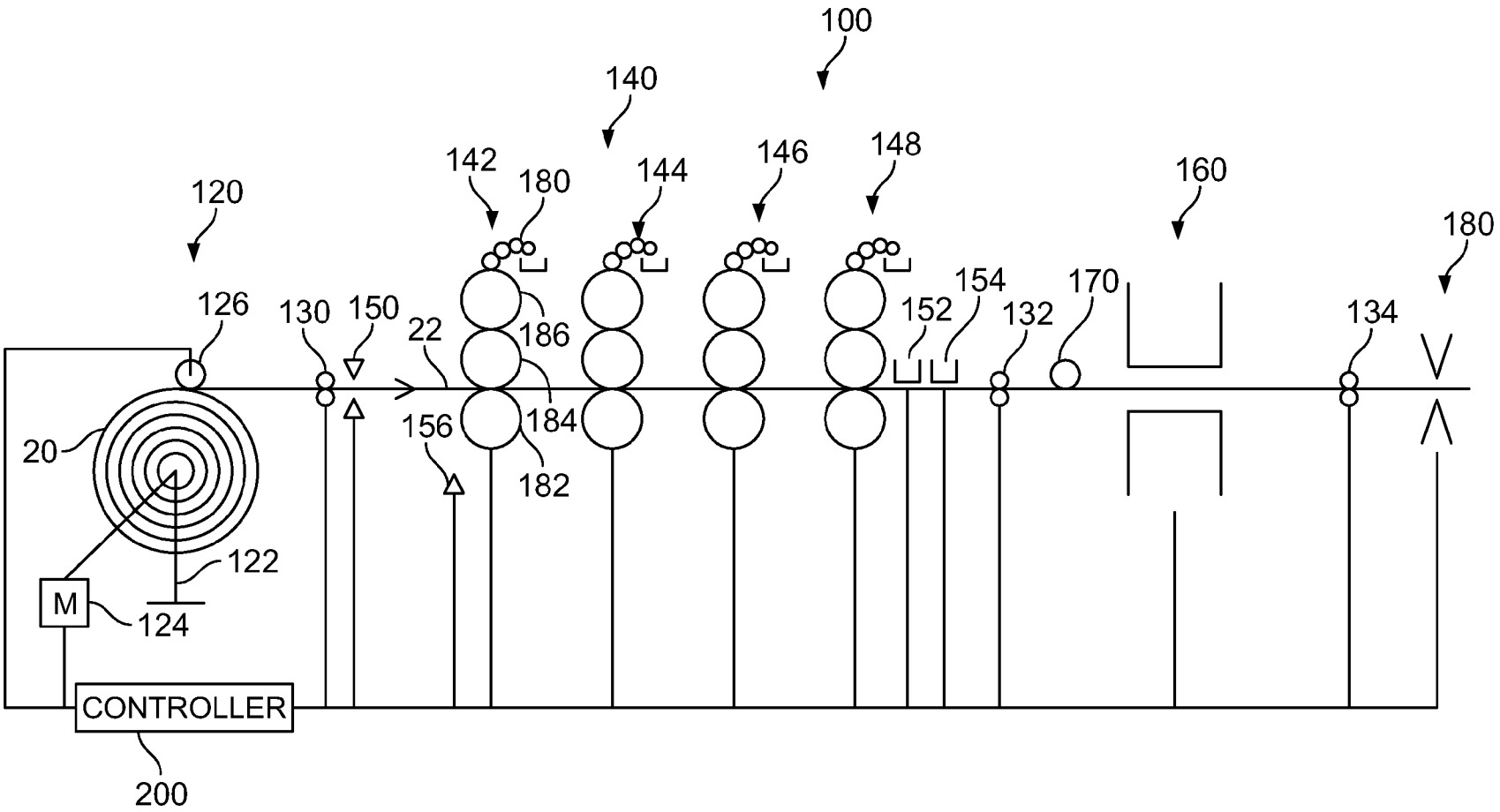
FIG. 1 shows a schematic view of a printing press according to the present invention during makeready.

FIG. 1 shows a web printing press 100 having a roll stand 120, a print unit section 140, a curing section 160 and a web processing section 180.

Roll stand 120 may include a frame 122 supporting a roll 20 of a substrate, such as cardboard, paper, or film. A reversible motor 124 can unwind or rewind the substrate, and is direction and speed controllable by a controller 200. A web guide 126 can be controlled by and provide inputs to controller 200. Web guide 126 can include for example web edge and tension sensors, can also control both the unwinding and rewinding of the substrate onto roll 20 so that the roll 20 can be properly unwound and rewound.

Motor 124 thus can unwind roll 20 to define a web 22, which can be guided by further web guides 130, 132, 134 through press 100.

A job counter 150 or impression counter 156 or other sensor can be used to track the substrate used during a makeready cycle.

Print unit section 140 can include print units 142, 144, 146, 148, for example printing cyan, magenta, yellow, and black respectively. Each print unit can include an ink supply 180 with ink keys, an impression cylinder 182, a blanket cylinder 184 and a plate cylinder 186. An individual drive motor can drive each print unit. Controller 200 can control each print unit, including the ink keys and their settings and the motors for the print units.

Sensors, including for example a register sensor 152 and optical density sensor 154 thus can be provided downstream of the print unit section 140 and connected to controller 200 to provide inputs on image quality on web 22.

Curing section 160 can include any curing units 162 necessary for the substrates to be printed, for example a dryer such as a GOSS ECOCOOL dryer and/or a UV curing unit.

A coater 170 can be provided to add a coating over the printed substrate, and can be provided prior to curing section 160, or, if after, can be provided with its own curer. For example coater 170 can provide a clear UV curable layer on web 22, and include a UV curing unit separate from curing section 160 if downstream of curing section 160.

Web processing section 180 can include any standard web processing units to form signatures or individual products from web 22, and may include stampers, creasers, longitudinal cutters, crosscutters, and any other web processing units. Web processing section 180 in one embodiment then has all processing units used to form flat cardboard box products from printed and cured web 22.

During makeready with the present invention both coater 170 and web processing section 180 are turned off, and the substrate permitted to run. Depending on the plant configuration and lengths, a reserve area downstream of the web processing section may be provided. Alternately, if desired, a diverted reserve area where the web 22 bypasses or is diverted from the web processing section may be provided for makeready substrate to be rolled back on roll 20. However, standard plant lengths may be sufficient for most or all makereadies and a downstream or diverted reserve area is not necessary.

As shown in the FIG. 1 embodiment, during makeready, substrate is unwound from roll 20 to define web 22. Web 22 is printed with four colors by print units 142, 144, 146, 148. Web 22 is not coated or processed into individual products but rather collected.

When controller 200, via sensors 152, 154, determines that web 22 is being printed to a desired standard, makeready stops. Ink keys at this points are properly set for the print job, and the print units cylinders properly regsistered.

Controller 200 then stops the web 22 and throws the blanket cylinders and/or impression cylinders of the print units off impression. Web 22 is then run further without being printed until all printed images are cured in curing unit 160.

Figure 2:
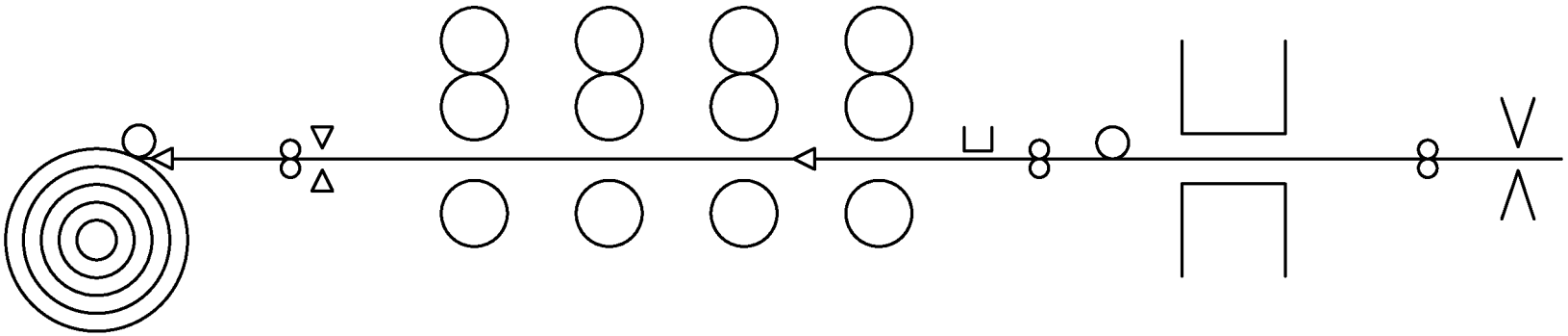
FIG. 2 shows a schematic view of the printing press of the present invention during a rewind step.

After all the images are cured, the web, including the nonprinted section and the cured makerady print section, is rewound on roll 20 by reversing motor 124. Reversing web guides 126, 130, 132, 134 can be set to a reversing mode to ensure that web 22 is properly guided back onto roll 20. Web 22 printed during the makeready thus passes back through the print unit section 140, as shown in FIG. 2. Not all of the cured makeready web 22 need to be placed back onto roll 20 however to reduce rethreading time, although this is possible.

The rewound roll 20 is then unwound again allowing the rewound substrate to pass through the print unit section 140, the print units being thrown back on impression and printing acceptable images over the imperfect makeready images.

However, if coater 170 is part of the print configuration, coater 170 is not run during the makeready, and if the makeready images are acceptable, the substrate during the unwind again step could simply then be coated without necessarily requiring a reprinting.

If, after printing has restarted, the desired optical density on reaching the images printed on a white web (i.e. not over the imperfect makeready images) after the unwind again step is for some reason not acceptable, the stopping, rewinding and unwind again steps can be repeated.

Figure 3:
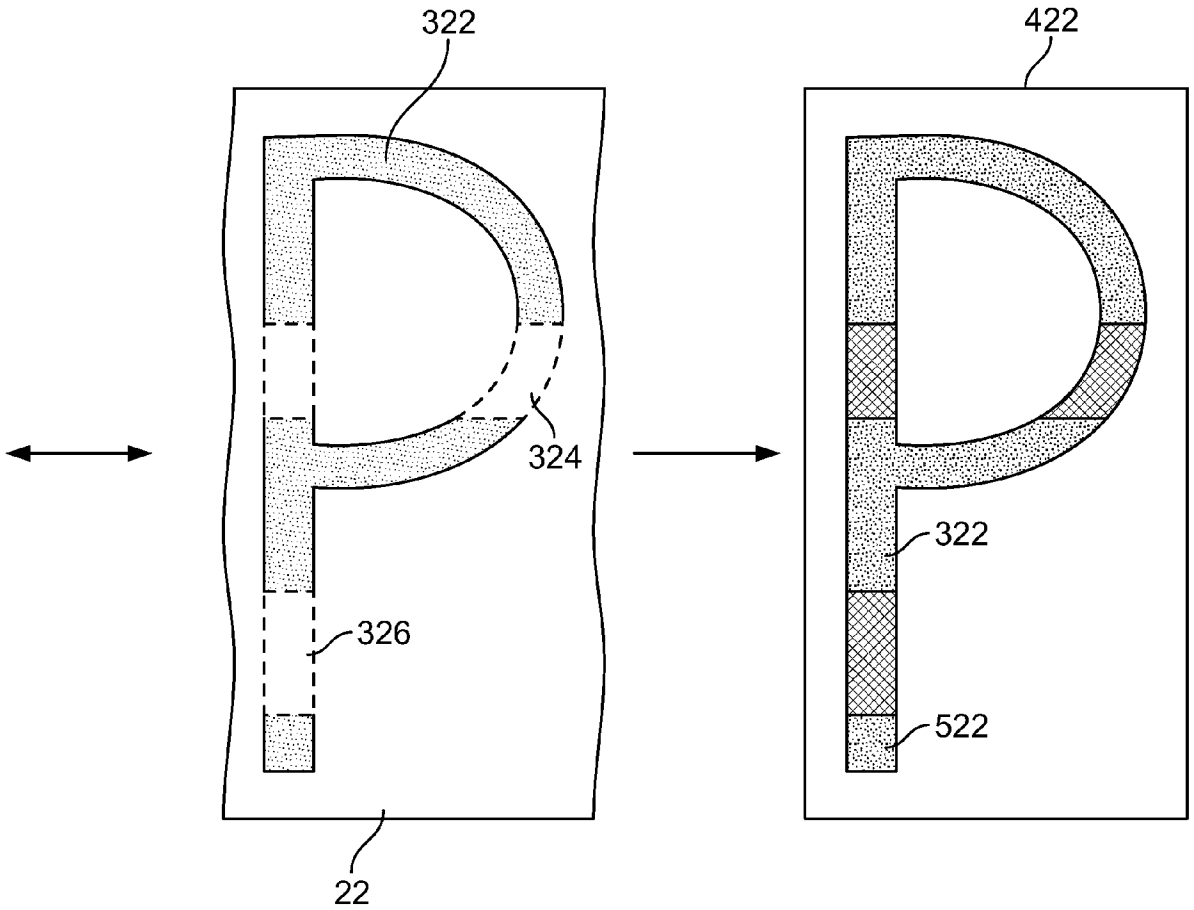
FIG. 3 shows a printed product according to the present invention.

FIG. 3 schematically shows a substrate 22, for example made of cardboard, and inked during makeready with an imperfect image 322, showing for example areas 324, 326 where keys have yet been properly adjusted for proper ink density. This substrate 22 and image 322, once cured for example by drying, is rewound on roll 20 after makeready when the keys have been properly adjusted, and then reprinted to form a printed product 422 having both imperfect image 322 and a post makeready image 522 printed overtop imperfect image 322. Due to the controller 200 and counter 150 and proper registration, the post makeready image 522 is printed almost directly over imperfect image 322. For many printing requirements, such as cardboard and other packaging, the resulting image combination on the makeready substrate 22 from images 322 and 522 is sufficient and the makeready substrate 22 can be fully reused.

What is claimed is:

1. A method for operating a web printing press comprising:

unwinding a substrate from a roll to define a web;

during makeready, printing the web using at least one print unit, the makeready ending when the web is being printed to a desired print quality standard;

stopping the web after the makeready;

throwing off impression the at least one print unit, and passing the printed substrate through a curing unit;

rewinding the web so that the cured printed substrate printed during the make ready passes back through the print unit; and unwinding again the rewound substrate to pass through the print unit.

2. The method as recited in claim 1 wherein the desired print quality standard is determined by measuring optical densities of the printed images and comparing the measured optical densities to a desired target density.

3. The method as recited in claim 1 further comprising, before the rewinding step, setting at least one web guides to guide a reversing web.

4. A method for operating a web printing press comprising:

unwinding a substrate from a roll to define a web;

during makeready, printing the web using at least one print unit, the makeready ending when the web is being printed to a desired print quality standard;

stopping the web after the makeready;

rewinding the web so that the substrate printed during the make ready passes back through the print unit; and unwinding again the rewound substrate to pass through the print unit;

wherein, during the unwind again step, the substrate is reprinted.

5. A method for operating a web printing press comprising:

unwinding a substrate from a roll to define a web;

during makeready, printing the web using at least one print unit, the makeready ending when the web is being printed to a desired print quality standard;

stopping the web after the makeready;

rewinding the web so that the substrate printed during the make ready passes back through the print unit; and unwinding again the rewound substrate to pass through the print unit;

wherein a coater is not run during the makeready, and if the makeready images are acceptable according to the desired print quality standard, the substrate during the unwind is coated.

6. A method for operating a web printing press comprising:

unwinding a substrate from a roll to define a web;

during makeready, printing the web using at least one print unit, the makeready ending when the web is being printed to a desired print quality standard;

stopping the web after the makeready;

rewinding the web so that the substrate printed during the make ready passes back through the print unit; and unwinding again the rewound substrate to pass through the print unit;

wherein if a desired optical density on reaching white web after the unwind again step is not acceptable, the stopping, rewinding and unwind again steps are repeated.

7. The method as recited in claim 1 further comprising tracking the substrate used during a makeready cycle.

* * * * *